United States Patent [19]

Waite et al.

[11] 3,939,852

[45] Feb. 24, 1976

[54] HAIR CURLING METHOD AND CURLER USED THEREWITH

[76] Inventors: Mary Irwin Waite, 14101 Ventura Blvd., Sherman Oaks, Calif. 91403; Eric L. Waite, 14808 Clark St., Van Nuys, Calif. 91401

[22] Filed: Oct. 12, 1973

[21] Appl. No.: 405,886

[52] U.S. Cl. ..... 132/39; 132/40

[51] Int. Cl.[2] ..... A45D 2/02

[58] Field of Search ..... 132/39, 40, 42, 36.1, 36.2, 132/9

[56] References Cited

UNITED STATES PATENTS

| | | | |
|---|---|---|---|
| 2,449,301 | 9/1948 | Interrante | 132/40 |
| 2,905,186 | 9/1959 | Pealzgraf | 132/33 |
| 3,101,724 | 8/1963 | Nizetich | 132/9 |
| 3,616,804 | 11/1971 | Simoneaux | 132/40 |

*Primary Examiner*—G. E. McNeill

[57] ABSTRACT

A hair curling method in which the hair is wound on a longitudinally slotted curler supported by a removable cylindrical core. With the hair wound a desired amount, the core is moved axially to remove it from the curler, leaving the hair wound on the curler. A bobby pin is then inserted through one of the slots of the curler to grip the layers of hair wound on the curler and secure the hair in a curl. The curler is removed from the hair curl by sliding axially, leaving the curl supported only by the bobby pin. The hair curler and core are then used for forming additional hair curls. The curler and core are provided in a plurality of different diameters so as to produce curls of the desired size and may be combined in kit form.

5 Claims, 7 Drawing Figures

H
10
11
12
13
14
15
16
P
C
7

HAIR CURLING METHOD AND CURLER USED THEREWITH

The curler used with the method is hollow, and is generally cylindrical in form. The curler has an annular flange extending outwardly on one end thereof and is provided with a plurality of relatively wide slots extending longitudinally inwardly from the opposite end thereof to a point spaced from but closely adjacent the annular flange. A core used with the curler has a diameter to closely fit within the curler and is hollow. The core has internal annular flanges at its opposite ends to provide a grip for the fingers of the user. The external flange on the curler assists the user in identifying the position of the curler by touch.

FIELD OF THE INVENTION

The present invention relates to a method of curling hair and a hair curler used therewith particularly adapted, but not limited, to home use.

SUMMARY OF THE INVENTION

The present method involves the forming of a hair curl on a curler, securing the curl with a bobby pin and completely removing the curler so that the same curler may be used for forming another curl.

The curler consists of a hollow, cylindrical member having an external annular flange at one end and longitudinally extending slots extending inwardly from the opposite end to a point spaced from but closely adjacent the annular flange. A core for supporting the curler is hollow and cylindrical in form with internal annular flanges at opposite ends to form a grip for handling the core.

The primary object of the invention is to provide a method of curling hair which permits the use of a single curler of the desired diameter for forming the curl and which is immediately removed from the formed curl so that the user need not retain the curler in place while the curl is being set.

Another object of the invention is to permit the hair to dry faster.

Other objects and advantages will become apparent in the following specification when considered in light of the attached drawings.

DESCRIPTION OF THE PREFERRED EMBODIMENT

Figures 1, 2, 3, 4, 5, 6, 7:
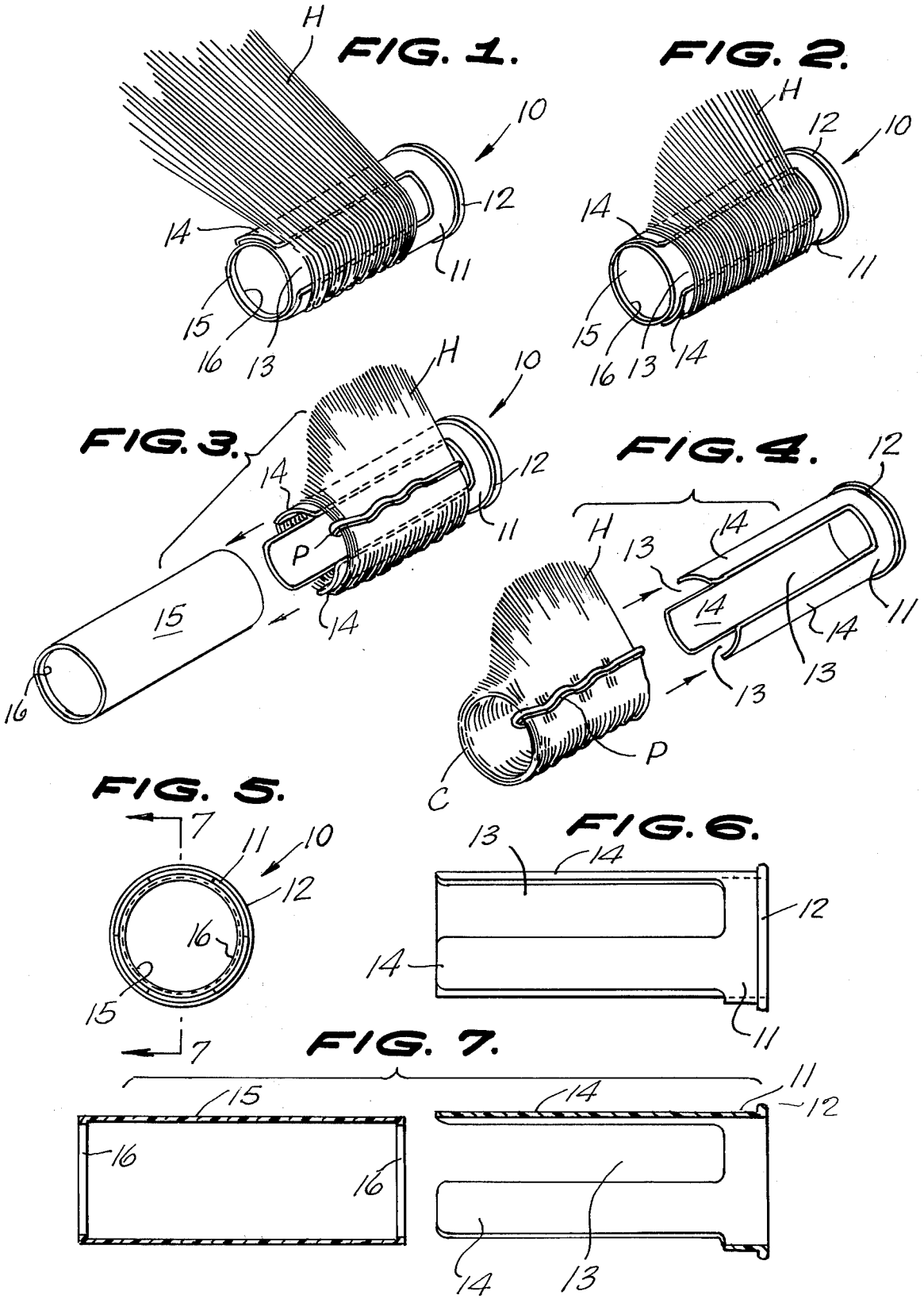
FIG. 1 is a perspective view of the curler used with the invention with the hair being wound thereon.
FIG. 2 is a view similar to FIG. 1 with the curler wound more tightly into the hair.
FIG. 3 is an exploded perspective view showing the core removed and a bobby pin clamped onto the curl within one of the slots of the curler.
FIG. 4 is an exploded perspective view of the curler removed from the curl showing the curl still supported by the bobby pin.
FIG. 5 is an end elevation of the curler and core in assembled position.
FIG. 6 is a side elevation of the curler.
FIG. 7 is an exploded longitudinal sectional view taken along the line 7–7 of FIG. 5, looking in the direction of the arrows.

Referring now to the drawings in detail wherein like reference characters indicate like parts throughout the several figures, the reference numeral 10 indicates generally a hair curler used with the method of the present invention.

The hair curler 10 is formed of a generally cylindrical hollow tube 11 having an external annular flange 12 formed on one end thereof.

A plurality of longitudinally extending relatively wide slots 13 extend inwardly from the end of the tube 11 opposite the flange 12 terminating at a point spaced from the flange 12 but closely adjacent thereto. The slots 13 are arranged in equispaced parallel relation and, as illustrated in the drawing, are three in number. The slots 13 delineate a plurality of spaced parallel fingers 14 as integral parts of the tube 11.

A generally cylindrical core 15 is dimensioned to fit within the tube 11 so as to be readily removable therefrom, as can be seen in FIGS. 1 and 2. The core 15 is hollow and is provided with an internal annular flange 16 at each end thereof.

The tube 11 and core 15 may be formed of any smooth material having a low coefficient of friction, such as plastic.

The method of the present invention is practiced in the following manner. The core 15 is first completely inserted into the tube 11 and the hair H of the user is then wound on the tube 11 with the fingers 14 supported by the core 15. After the hair H has been wound to some extent on the tube 11, the core 15 is withdrawn from the tube 11 by engaging the fingernail of the user with one of the flanges 16 and axially sliding core 15 from the tube 11, leaving the hair H wound on the tube 11. Tube 11 is then rotated toward the head in order to tighten the curl. A bobby pin P is engaged over the layers of hair H by inserting it through one of the slots 13 of the tube 11. The tube 11 is withdrawn from the curl C and the bobby pin P holds the curl C while the curler 10 or another similar curler of different diameter is used to form additional curls.

With the method of the present invention, the hair curls are held without the necessity of supporting each curl on a separate curler for an extended period of time, thus eliminating the unsightly appearance created by a head full of curlers.

Using this method to curl the hair will permit the air to circulate more freely because it eliminates the use of bulky curlers in the hair. Therefore the hair will dry faster.

Having thus described the method and curler used with the present invention, it should be understood that numerous structural changes and deviations in the method may be restored to without departing from the spirit of the invention.

What is claimed is:

1. A hair curler comprising:

a first member; and a second member, said second member being tubular having at least one open end, said first member being telescopingly receivable within said second member establishing a close fitting relationship therebetween, said second member having a plurality of longitudinal slots connecting with one end of said second member and extending to a point close to but spaced from the other end of said second member, said slots being spaced apart with the portions of said second member between adjacent said slots forming inwardly deflectable fingers, a lock of hair is to be tightly wound upon said second member and said first member is to be removed which permits said fingers to deflect inwardly which facilitates removal of the resultant hair curl after insertion of a hair pin through a said slot across the hair curl to clamp the curl and maintain its curled position.

2. The hair curler as defined in claim 1 wherein:

both said first member and said second member being basically cylindrical in configuration.

3. The hair curler as defined in claim 2 wherein:

therebeing three in number of said slots with said slots being equiangularly spaced apart about said second member.

4. The hair curler as defined in claim 3 wherein:

each said slot being of constant width causing said fingers to be parallel.

5. The hair curler as defined in claim 5 wherein:

said second member including an external annular flange formed on one end thereof, said slots extending longitudinally into said second member from the end thereof opposite said flange and extending to a point close to but spaced from said flange.

* * * * *